US011336024B2

(12) United States Patent
Sakurai et al.

(10) Patent No.: US 11,336,024 B2
(45) Date of Patent: May 17, 2022

(54) REFLECTION REDUCING APPARATUS

(71) Applicant: DENSO CORPORATION, Kariya (JP)

(72) Inventors: Kazumasa Sakurai, Nisshin (JP); Toshiya Sakai, Kariya (JP)

(73) Assignee: DENSO CORPORATION, Kariya (JP)

( * ) Notice: Subject to any disclaimer, the term of this patent is extended or adjusted under 35 U.S.C. 154(b) by 49 days.

(21) Appl. No.: 17/038,625

(22) Filed: Sep. 30, 2020

(65) Prior Publication Data

US 2021/0028551 A1 Jan. 28, 2021

Related U.S. Application Data

(63) Continuation of application No. PCT/JP2019/014841, filed on Apr. 3, 2019.

(30) Foreign Application Priority Data

Apr. 5, 2018 (JP) ..... JP2018-073054

(51) Int. Cl.

| | |
|---|---|
| ***H01Q 15/02*** | (2006.01) |
| ***H01Q 15/24*** | (2006.01) |
| ***H01Q 1/48*** | (2006.01) |
| ***H01Q 1/52*** | (2006.01) |
| ***H01Q 21/06*** | (2006.01) |
| ***H01Q 21/24*** | (2006.01) |

(52) U.S. Cl.

CPC ..... *H01Q 15/24* (2013.01); *H01Q 1/48* (2013.01); *H01Q 1/52* (2013.01); *H01Q 21/065* (2013.01); *H01Q 21/24* (2013.01)

(58) Field of Classification Search

CPC ..... H01Q 15/24; H01Q 1/48; H01Q 1/52; H01Q 21/065; H01Q 21/24; H01Q 1/243

See application file for complete search history.

(56) References Cited

U.S. PATENT DOCUMENTS

2018/0366818 A1* 12/2018 Kawaguchi ..... H01Q 1/3233

FOREIGN PATENT DOCUMENTS

JP 2014-045378 A 3/2014

* cited by examiner

*Primary Examiner* — Dieu Hien T Duong

(74) *Attorney, Agent, or Firm* — Maschoff Brennan

(57) ABSTRACT

A reflection reducing apparatus includes a dielectric base plane (30), a first patch group, a second patch group, and a ground plate (40). A plurality of first conductive patches (10) each resonate in a first direction (α) and a second direction (β) which are different in resonant length from each other. A plurality of second conductive patches include a first direction-oriented patch (20*a*) and a second direction-oriented patch (20*b*) which are different in resonant length from each other. The second conductive patches are arranged along an outer periphery of the first patch group at an interval away from the first patch group.

8 Claims, 18 Drawing Sheets

COMPARATIVE EXAMPLE

REFLECTION REDUCING APPARATUS

CROSS REFERENCE TO RELATED DOCUMENTS

The present application claims the benefit of priority of Japanese Patent Application No. 2018-073054 filed on Apr. 5, 2018, the disclosure of which is totally incorporated herein by reference.

TECHNICAL FIELD

This disclosure generally relates to a technique for reducing an effect of a reflected wave.

BACKGROUND ART

A reflective array, as taught in patent literature 1, is equipped with a plurality of elements which reflect incident waves, and works to control phase differences in reflective waves between the elements which are arranged adjacent each other in an x-axis direction and phase differences in reflective waves between the elements which are arranged adjacent each other in a y-axis direction, thereby reflecting incident waves coming from a first direction to a second direction.

PRIOR ART DOCUMENT

Patent Literature

PATENT LITERATURE 1 Japanese patent first publication No. 2014-45378

SUMMARY OF THE INVENTION

The reflected waves may adversely impinge on radio wave environments. For instance, when an emitted light which has been reflected by an object is returned and then reflected again, such a re-reflected wave may interfere with an emitted wave, so that the emitted wave attenuates. The use of the reflective array, as taught in patent literature 1 in order to control the adverse effect of the reflected wave causes the reflected wave to be oriented in a direction different from that of the emitted wave, thereby reducing the adverse effect of the reflected wave. After careful consideration, the inventor of this application, however, has found that the reflective array in patent literature 1 works only to change a direction of wave reflection into a direction of wave incidence rather than reduction in reflected wave which may cause the adverse effect, and thus found a difficulty in eliminating the adverse effect completely.

One aspect of this disclosure is preferably provide a reflection reducing apparatus which effectively reduce adverse effects of a reflected wave.

According to one aspect of this disclosure, there is provided a reflection reducing apparatus which comprises: (a) a dielectric base plate that has a first surface and a second surface; (b) a first patch group that is disposed on the first surface and includes a plurality of first conductive patches; (c) a second patch group that is disposed on the first surface and includes a plurality of second conductive patches; and (d) a ground plane that is arranged on the second surface and works as a grounding surface. The plurality of first conductive patches are electrically insulated from each other. Each of the first conductive patches in which electrical currents, as excited by incoming waves that are radio waves arriving from outside the reflection reducing apparatus, resonates in directions at least including a first direction and a second direction. Each of the first conductive patches is of a patch shape in which resonant lengths are different between the first and second directions. The second conductive patches are equipped with two or more kinds of conductive patches including at least one first direction-oriented patch and at least one second direction-oriented patch. The second conductive patches are arranged along an outer edge of the first patch group at an interval away from the first patch group. The first direction-oriented patch has a shape in which the electrical current resonates only in the first direction. The second direction-oriented patch has a shape in which the electrical current resonates only in the second direction and which has a resonant length different from that of the first direction-oriented patch.

According to this disclosure, the first patch group and the second patch group are disposed on the first surface of the dielectric base plate. The plurality of first conductive patches of the first patch group each have the excited electrical currents resonating at least in the first direction and the second direction and also have a shape in which resonant lengths in the first and second directions are different from each other. A reflection phase of the first conductive patch in the first direction is, therefore, different from that of the first conductive patch in the second direction. This causes a direction of polarization of a reflected wave arising from reflection of the incoming wave by the first conductive patches to be rotated from a direction of polarization of the incoming wave. The first patch group, therefore, works to reduce adverse effects of the reflected wave. The plurality of second conductive patches of the second patch group work to change the direction of polarization of the reflected wave to a direction different from the direction of polarization of the incoming wave with aid of a combination of the first direction-oriented patch and the second direction-oriented patch, thereby reducing the adverse effects of the reflected wave.

Each of the first direction-oriented patch and the second direction-oriented patch is shaped to resonate only in one direction and smaller in size than the first conductive patches which resonate at least two directions. This enables the first direction-oriented patch and the second direction-oriented patch to be disposed in spaces which are too narrow to arrange the first conductive patches. In other words, it is possible to arrange the first direction-oriented patch and the second direction-oriented patch in a region outside the first patch group wherein there is no space for installation of the first conductive patches. This facilitates the reduction in adverse effects of the reflected wave.

EMBODIMENTS FOR CARRYING OUT THE INVENTION

Exemplified embodiments which embody this disclosure will be described below with reference to the drawings.

First Embodiment

1 Structure

Figure 1:
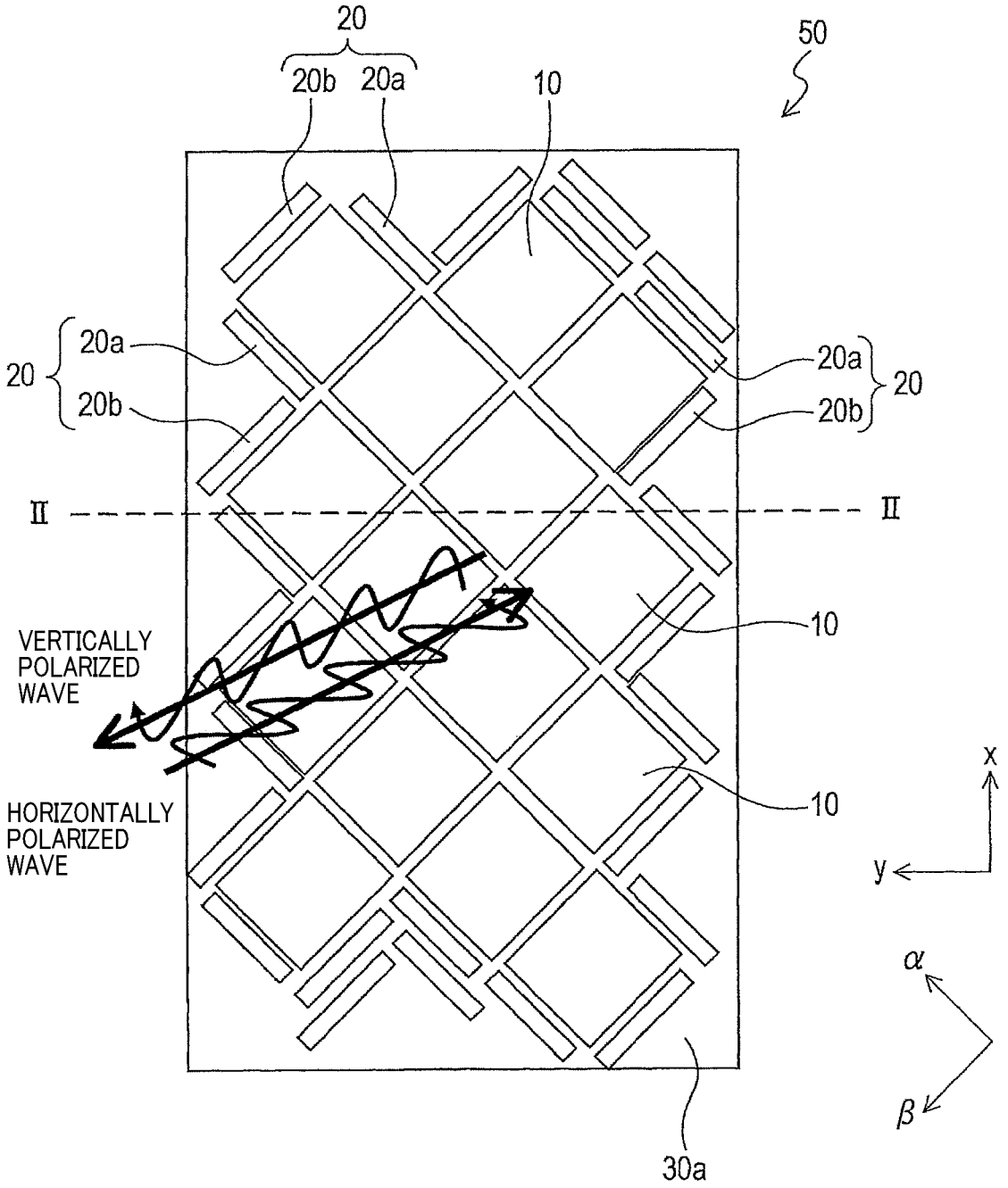
FIG. 1 is a plan view which schematically illustrate a structure of a reflection reducing apparatus according to the first embodiment.
Figure 2:
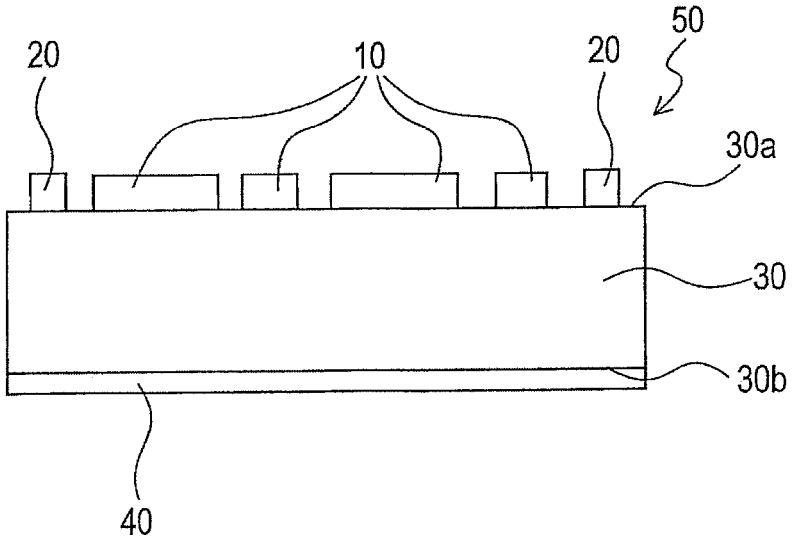
FIG. 2 is a vertical sectional view which illustrates a cross section taken along the line II-II in FIG. 1.

The structure of the reflection reducing device 50 in this embodiment will be described below with reference to FIGS. 1 and 2. The reflection reducing device 50 is equipped with the rectangular dielectric base plate 30. The dielectric base plate 30 includes the base plate front surface 30*a* and the base plate reverse surface 30*b*. The base plate front surface 30*a* and the base plate reverse surface 30*b* are used as pattern-forming layers. In the following discussion, a direction in which a first side of the dielectric base plate 30 extends will also be referred to as an x-axis direction. A direction in which a second side of the dielectric base plate 30 extends will also be referred to as a y-axis direction. A direction in which a line normal to the base plate front surface 30*a* extends will also be referred to as a z-axis direction.

The reflection reducing device 50 also includes the ground plate or plane 40, a first patch group, and a second patch group in addition to the dielectric base plate 30. The ground plane 40 is attached to the base plate reverse surface 30*b*. The first patch group and the second patch group are disposed on the base plate front surface 30*a*. The ground plane 40 is made in the form of a copper pattern and covers the whole of a surface of the base plate reverse surface 30*b*. The ground plane 40 serves as a grounding surface.

The first patch group includes a plurality of first conductive patches 10. The first conductive patches 10 are periodically two-dimensionally arranged in the form of a passive pattern. The first conductive patches 10 are each designed in the form of a rectangular copper pattern. Each of the first conductive patches 10 is arranged to have each side inclined at 40° to the x-axis. Specifically, each of the first conductive patches 10 has first sides and second sides. In the following discussion, a direction in which the first sides extend will be referred to as an a direction. A direction in which the second sides extend will be referred to as a β direction. The a direction and the β direction are oriented perpendicular to each other. Each of the first conductive patches 10 has a length La1 in the a direction and a length Lβ1 in the β direction. The length La1 is different from the length Lβ1.

The first conductive patches 10 are electrically insulated from each other and inclined at the same angle. The first conductive patches 10 are arranged at equal intervals away from each other both in the a direction and in the β direction. As many first conductive patches 10 as possible are disposed on the base plate front surface 30*a*. In other words, an area on the base plate front surface 30*a* which is unoccupied by the first conductive patches 10 is so small so that the first conductive patches 10 cannot be disposed.

The second patch group includes a plurality of second conductive patches 20. The second conductive patches 20 include at least one first direction-oriented patch 20*a* and at least one second direction-oriented patch 20*b*. The first direction-oriented patch 20*a* is designed in the form of a copper pattern extending linearly in the a direction. The second direction-oriented patch 20*b* is designed in the form of a copper pattern extending linearly in the β direction. The first direction-oriented patch 20*a* has a length La2 which is identical with the length La1 of the first conductive patches 10. The second direction-oriented patch 20*b* has a length Lβ2 which is identical with the length Lβ1 of the first conductive patches 10.

The second patch group is arranged along an outer edge of the first patch group at an interval away from the first patch group on the base plate front surface 30*a*. The outer edge of the first patch group includes a plurality of sides extending in the a direction and a plurality of sides extending in the β direction. The first direction-oriented patch 20*a* extends along the a direction-oriented side of the outer edge of the first patch group at an interval away from the outer edge of the first patch group. The second direction-oriented patch 20*b* extends along the β direction-oriented side of the outer edge of the first patch group at an interval away from the outer edge of the first patch group. The first direction-oriented patch 20*a* and the second direction-oriented patch 20*b* are located adjacent each other.

A plurality of first direction-oriented patches 20*a* and a plurality of second direction-oriented patches 20*b* may be arranged to extend along the outer edge of the first patch group and located adjacent each other. As many first direction-oriented patches 20*a* and the second direction-oriented patches 20*b* as possible are disposed adjacent each other between the outer edge of the first patch group and a periphery of the base plate front surface 30*a*. Specifically, the first direction-oriented patches 20*a* and the second direction-oriented patches 20*b* are smaller in size than the first conductive patches 10 and thus arranged to occupy space too narrow to be occupied by the first conductive patches 10.

2 Operation

Here, it is assumed that radio waves (which will be referred to below as incoming waves) coming from outside the reflection reducing device 50 include a horizontally polarized wave oriented in the x-direction. In other words, the directions a and β are inclined at an angle to the direction of polarization of the incoming waves. When the incoming waves enter the reflection reducing device 50, it will cause electrical currents, as excited by the incoming waves, to flow both in the a direction-oriented sides and in the β direction-oriented sides of the first conductive patches 10 and resonate in the a direction and the β direction. The length La1 of the a direction-oriented sides is different from the length of Lβ1 of the β direction-oriented sides, so that resonant lengths in the a direction and the β direction are different from each other, thus resulting in a difference in reflection phase between the a direction and the β direction. This causes a direction of polarization of reflected waves arising from reflection of the incoming waves to changed or different from that of the incoming waves by the first conductive patches 10.

Figure 3:
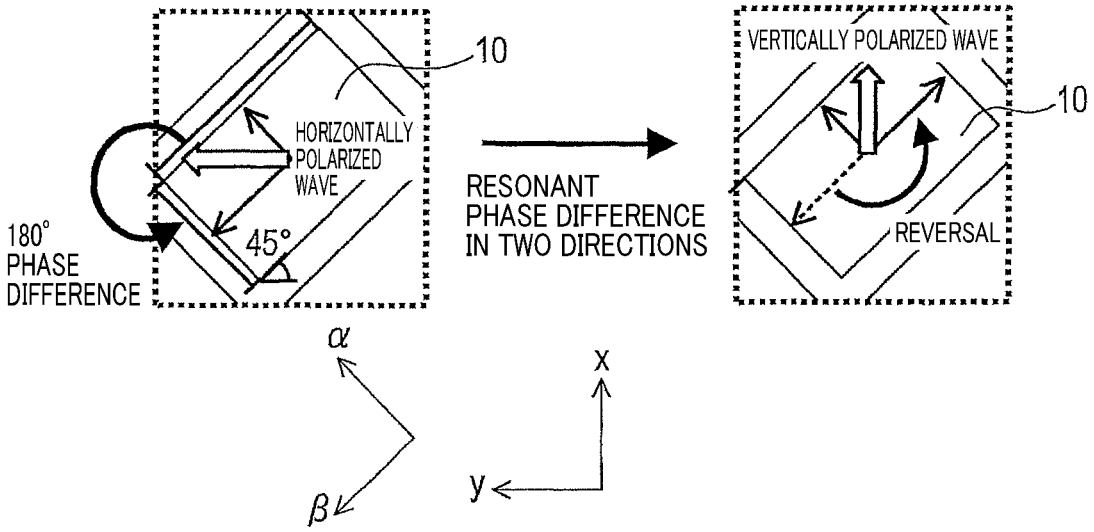
FIG. 3 is a view for explanation of rotation of a polarized wave by a conductive patch.
Figure 4:
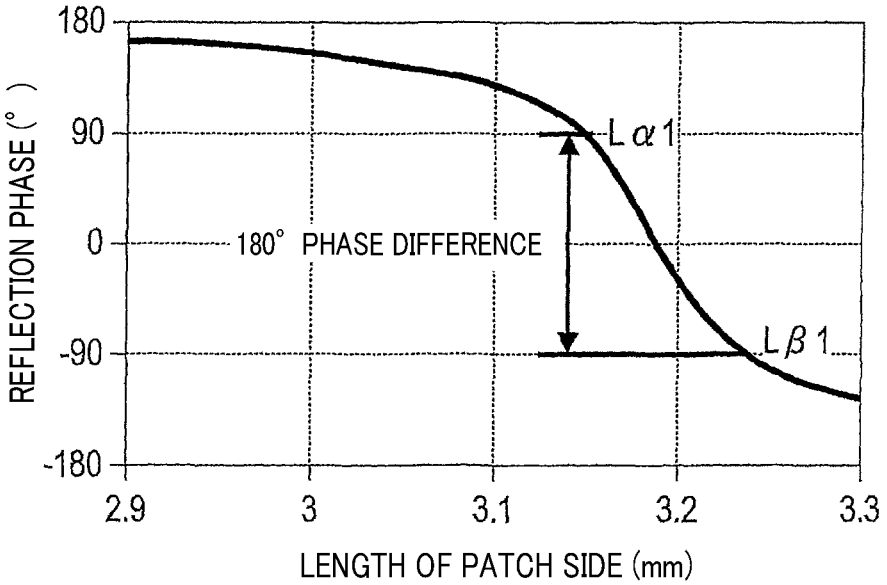
FIG. 4 is a graph which represents a relation between a length of a side of a conductive patch and a reflection phase during resonation.

Specifically, the lengths La1 and Lβ1 are selected to have a 180° phase difference Δθ1 in reflection phase between the a direction and the β direction of the first conductive patches 10 in a condition where the incoming wave has a predetermined wave length. In other words, the first conductive patches 10 are shaped to resonate in opposite phases between the a direction and the β direction. FIG. 4 shows that the lengths of the a direction-oriented side and the β direction-oriented side of the first conductive patch 10 correlate with the reflection phase. The values of the lengths La1 and Lβ1 are, therefore, determined by simulations to set the phase difference Δθ1 to 180°. The direction of polarization of the reflected wave is, as demonstrated in FIG. 3, changed from that of the incoming wave to that of vertical polarization along the y-direction. This reduces interference of the reflected wave with the incoming wave and adverse effects of the reflected wave on a receiver designed to have sensitivity to the incoming wave.

The first direction-oriented path 20*a* of the second conductive patches 20 has the length La2 which is equal to the length La1. The second direction-oriented patch 20*b* has the length Lβ2 which is equal to the Lβ1. The phase difference Δθ2 in reflection phase between the first direction-oriented patch 20*a* and the second direction-oriented patch 20*b* is, therefore, 180°. The second conductive patch 20, therefore, functions to orient the direction of polarization of the reflection wave to that of vertical polarization along the y-axis direction using the first direction-oriented patch 20*a* and the second direction-oriented patch 20*b* which are arranged adjacent each other.

Each of the first conductive patches 10 itself offers an insufficient polarized wave changing effects, but all the first conductive patches 10 periodically arranged work to produce sufficient polarized wave changing effects as a whole. In the absence of the second patch group on the base plate front surface 30*a*, there is an unoccupied area around the outer edge of the first patch group, which will produce insufficient polarized wave changing effect. In contrast to this, this embodiment has the small-sized first direction-oriented patch 20*a* and second direction-oriented patch 20*b* which are disposed on an area of the base plate front surface 30*a* where it is impossible to place the first conductive patches 10. Specifically, the reflection reducing device 50 is designed to have the periodic structure arranged outside the outer edge of the first patch group, thereby achieving sufficient polarized wave changing effect and offering reflection reducing effects higher than when there is no second patch group.

If the reflection reducing device 50 is designed not to have the first patch group and to have additional second conductive patches 20 arranged instead of the first conductive patches 10, it will result in an increased area between the second conductive patches 20 as compared with use of the first conductive patches 10 and the second conductive patches 20, which will result in a reduction in polarized wave changing effect. It is, therefore, advisable that as many of the first conductive patches 10 as possible be arranged on the base plate front surface 30*a*, and as many of the second conductive patches 20 be disposed in a void between the outer edge of the first patch group and the periphery of the base plate front surface 30*a*.

Figure 5:
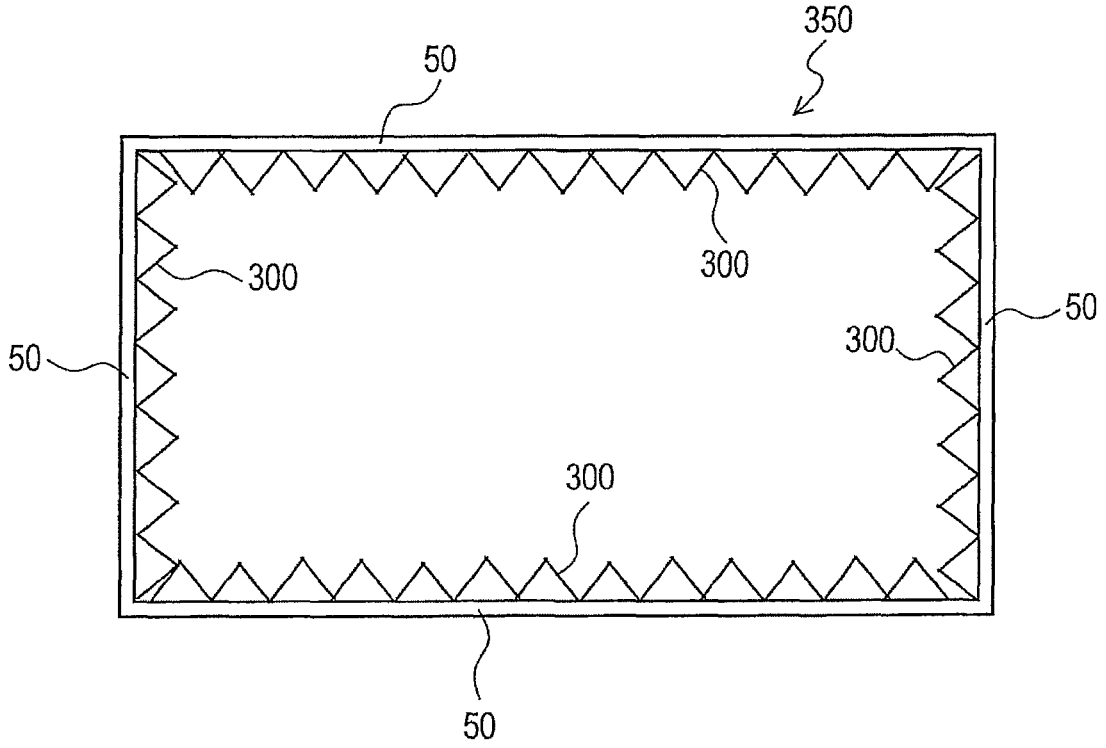
FIG. 5 is a view which illustrates an anechoic chamber in which a reflection reducing apparatus in the first embodiment is installed.

FIG. 5 illustrates the anechoic chamber 350 that is an example of use of the reflection reducing device 50. Typical anechoic chambers are chambers having radiation-absorbent materials attached to inner surfaces of a ceiling and side walls thereof to absorb reflection of electrical waves produced therein. The anechoic chamber 350 has the reflection reducing devices 50 attached to inner surfaces of a ceiling and side walls thereof and also has radio wave absorbers 300 attached to upper surfaces of the reflection reducing device 50. Radio waves, as generated inside the anechoic chamber 350 and entering the inner surfaces of the anechoic chamber 350, are absorbed by the radio wave absorbers 300. Some of the radio waves unabsorbed by the radio wave absorbers 300 in the anechoic chamber 350 are reflected and changed in direction of polarization thereof by the reflection reducing device 50. The anechoic chamber 350, therefore, reduces adverse effects of reflection of the radio waves occurring inside the anechoic chamber 350 more greatly than an anechoic chamber not having the reflection reducing devices 50 attached to inner surfaces thereof.

3 Beneficial Advantage

The above described first embodiment offers the following beneficial advantages.

1) The first conductive patches 10 are in the shape of a pattern which resonates both in the a direction and in the β direction and in which resonant lengths are different between the a direction and in the β direction. This results in a difference in reflection phase of the first conductive patches 10 between the a direction and in the β direction, thereby causing a direction of polarization of a reflected wave arising from reflection of the incoming wave by the first patch group to be different from a direction of polarization of the incoming wave. The second conductive patches 20 also work to orient the direction of polarization of the reflected wave to a direction different from the direction of polarization of the incoming wave with aid of combinations of the first direction-oriented patches 20*a* and the second direction-oriented patches 20*b*.

Each of the first direction-oriented patch 20*a* and the second direction-oriented patch 20*b* is in the shape of a pattern which resonate only in one direction and smaller in size than the first conductive patches 10 which resonate in two directions. It is, therefore, possible to place the first direction-oriented patch 20*a* and the second direction-oriented patch 20*b* in space which is too narrow to arrange the first conductive patches 10. Specifically, the first direction-oriented patch 20*a* and the second direction-oriented patch 20*b* are arranged in an area which is located outside the first patch group and in which the first conductive patches 10 cannot be disposed. This greatly reduces the adverse effects of the reflected wave as compared with when only the first conductive patches 10 are mounted on the base plate front surface 30*a*.

2) The a direction and the β direction are perpendicular to each other. The first conductive patches 10 are each shaped to resonate with opposite phases in the a direction and the β direction. The first conductive patches 10, therefore, works to turn the direction of polarization of the reflected wave by 90° from the direction of polarization of the incoming wave. The first direction-oriented patch 20*a* and the second direction-oriented patch 20*b* of the second conductive patches 20 resonate in phases opposite each other. The second conductive patch 20 made up of a combination of the first direction-oriented patch 20*a* and the second direction-oriented patch 20*b*, thus, function to turn the direction of polarization of the reflected wave by 90° from that of the incoming wave.

3) The first conductive patches 10 are all inclined at the same angle and arranged at equal intervals away from each other. The whole of the first conductive patches 10, therefore, functions to orient the direction of polarization of the reflected wave in a direction different from that of the incoming wave.

4) The first direction-oriented patch 20*a* and the second direction-oriented patch 20*b* are arranged adjacent each other and thus function together to orient the direction of polarization of the reflected wave in a direction different from that of the incoming wave.

Second Embodiment

1 Difference from the First Embodiment

The second embodiment is identical in basic structure with the first embodiment. Explanation of the same parts will, thus, be omitted, and differences will be mainly discussed below. The same reference numbers as employed in the first embodiment will represent the same parts to which the previous explanation will refer.

The reflection reducing device 150 in the second embodiment is different from the reflection reducing device 50 in the first embodiment in that the reflection reducing device 150 is equipped with the antenna portions 60. The structure of the reflection reducing device 150 will be described below with reference to FIGS. 6 to 9.

Figure 6:
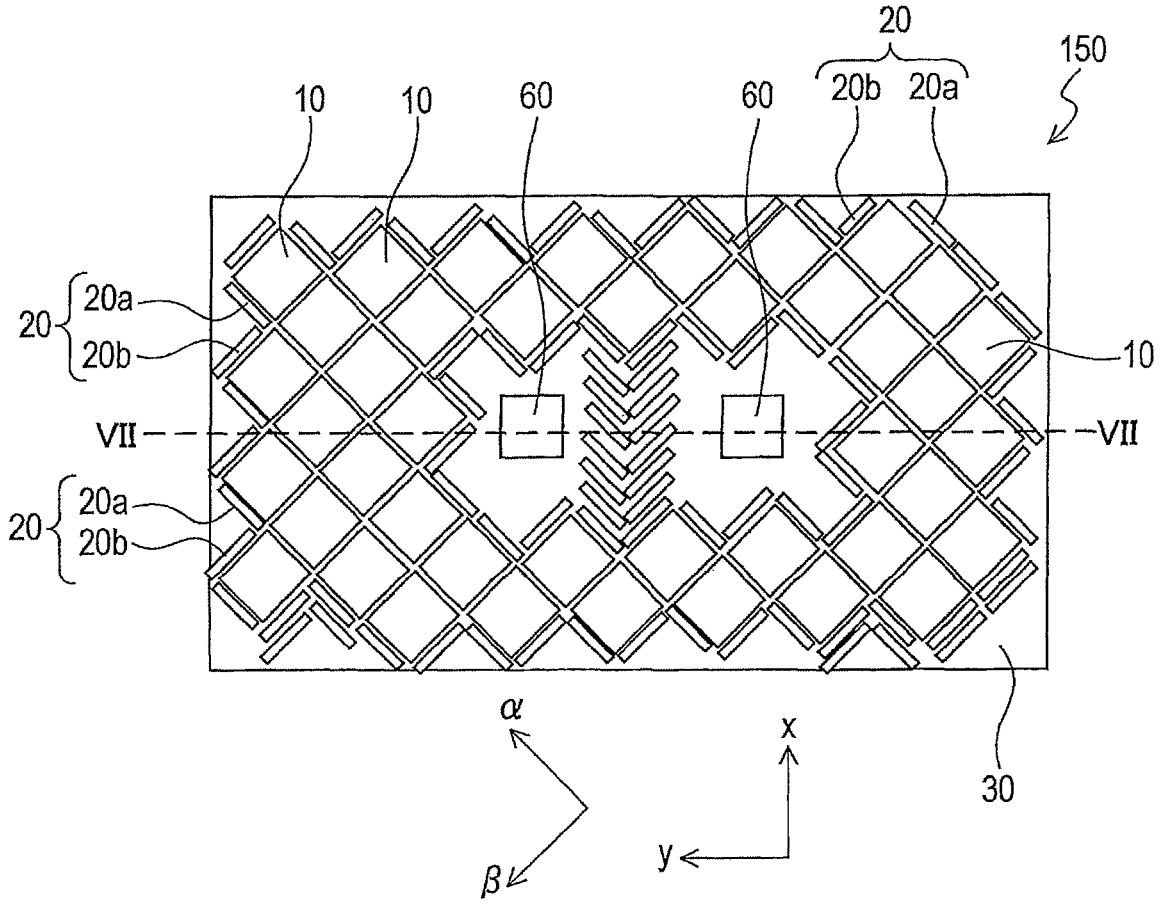
FIG. 6 is a plan view which schematically illustrates a structure of a reflection reducing apparatus according to the second embodiment.
Figure 7:
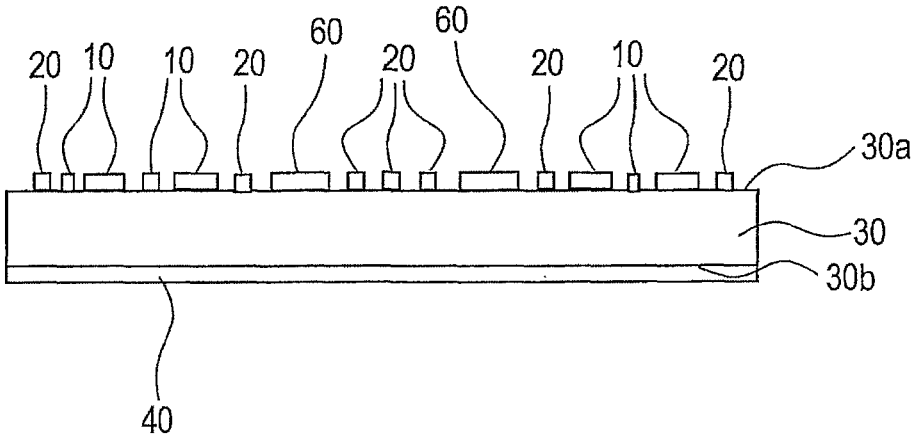
FIG. 7 is a vertical sectional view taken along the line VII-VII in FIG. 6.

The reflection reducing device 150, as illustrated in FIGS. 6 and 7, has the first patch group, the second patch group, and at least one antenna portion 60 mounted on the base plate front surface 30*a*. The first patch group includes a plurality of first conductive patches 10. The second patch group includes a plurality of second conductive patches 20. The antenna portion 60 is, as clearly illustrated in FIGS. 8 and 9, equipped with a plurality of patch antennas 60*a* and a plurality of feeders 60*b*. A wave radiated from the antenna portion 60 has a horizontally polarized wave oriented in the x-direction. The first conductive patches 10 are oriented to have two sides which extend perpendicular to each other in the a direction and the β direction, respectively, which are inclined at 45° to the x-direction. The first direction-oriented patch 20*a* extends in the a direction. The second direction-oriented patch 20*b* extends in the β direction.

Figure 8:
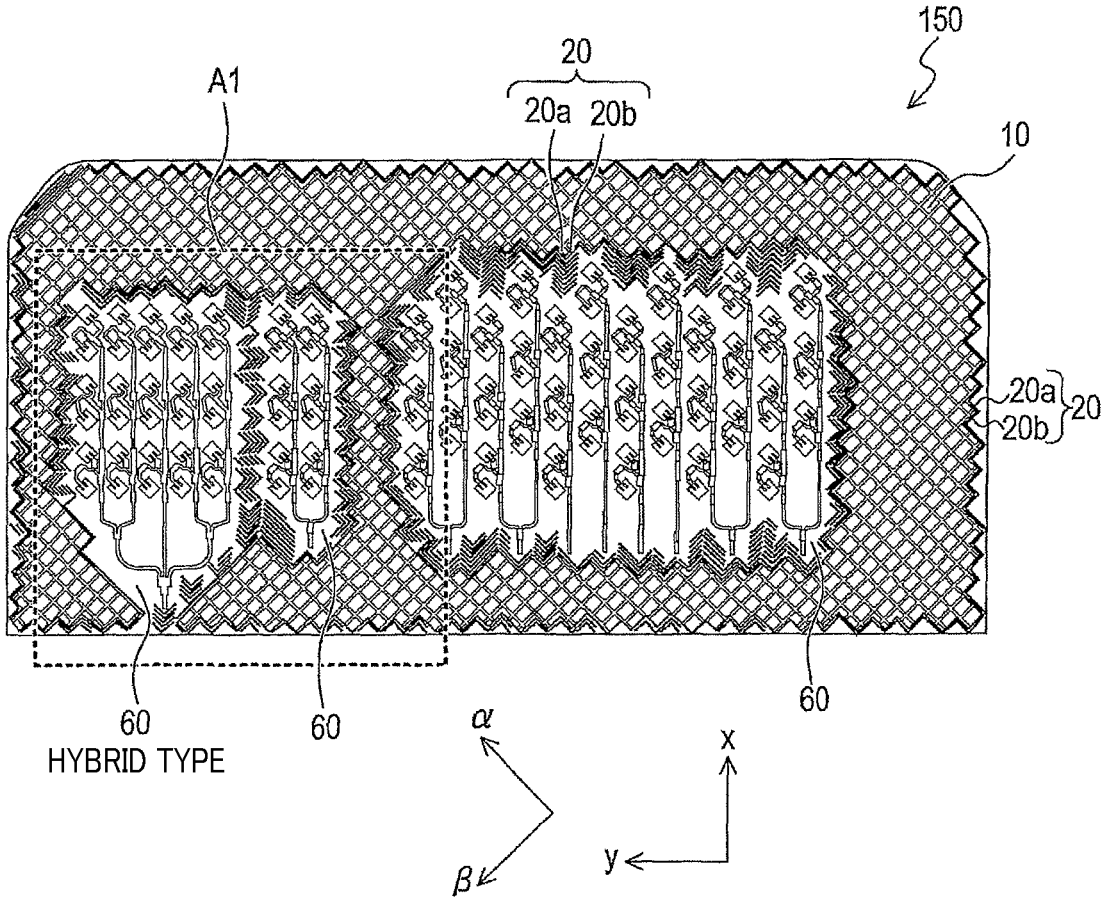
FIG. 8 is a plan view which illustrates a structure of a reflection reducing apparatus according to the second embodiment.
Figure 9:
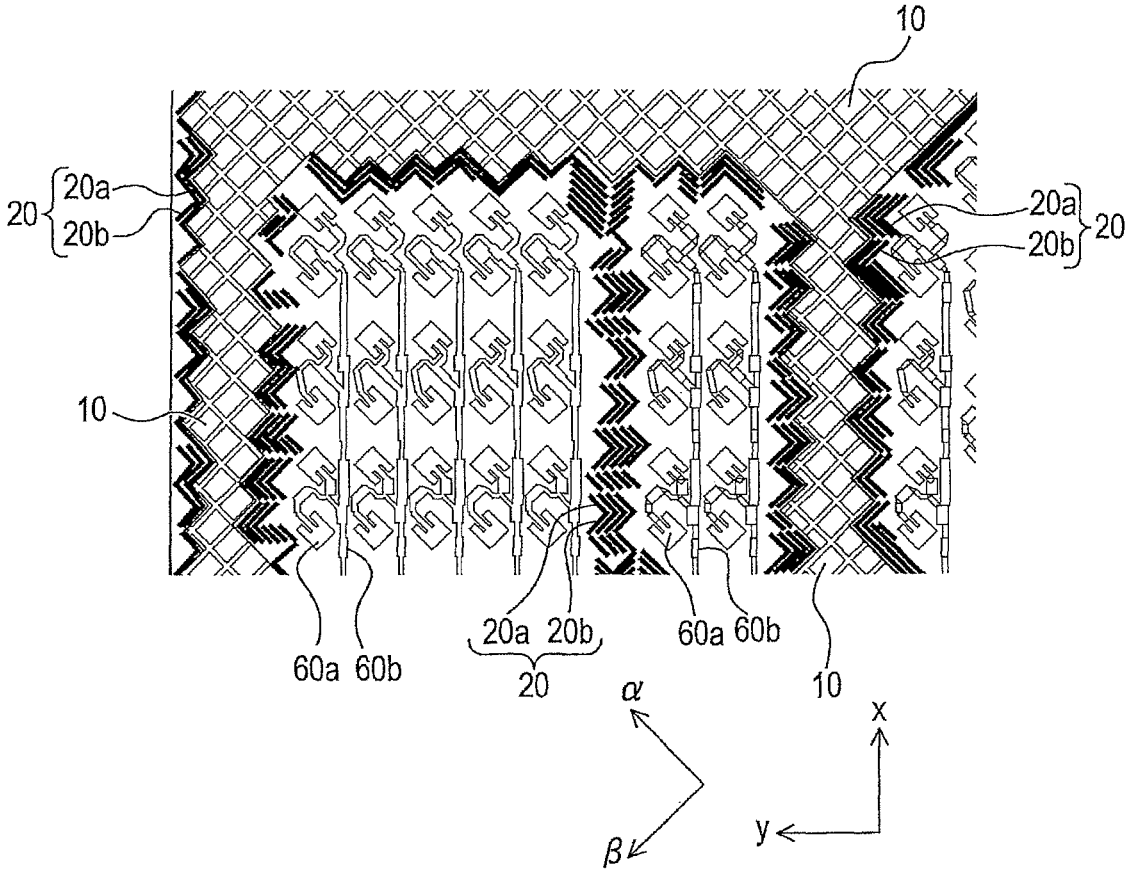
FIG. 9 is an enlarged view of a portion A1 in FIG. 8.

The second patch group is, as can be seen in FIGS. 8 and 9, arranged in the vicinity of the antenna portions 60 and in a periphery-inside region of the base plate front surface 30*a*. The first patch group is arranged in an area of the base plate front surface 30*a* except the antenna portion 60, a region near the antenna portion 60, and the periphery-inside region of the base plate front surface 30*a*. Specifically, the reflection reducing device 150 has as many first conductive patches 10 as possible which are arranged around the antenna portions 10 formed on the base plate front surface 30*a*. The first direction-oriented patch 20*a* and the second direction-oriented patch 20*b* are disposed in gaps between outer edges of the first conductive patches 10 and the antenna portions 60 and between the outer edges of the first conductive patches 10 and the periphery of the base plate front surface 30*a*.

Figure 12:
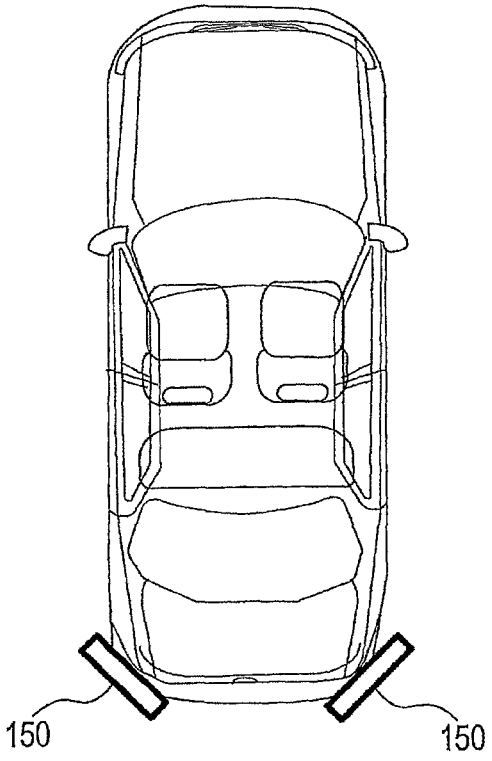
FIG. 12 is a view which illustrates locations of reflection reducing apparatuses in a vehicle according to the second embodiment.
Figure 13:
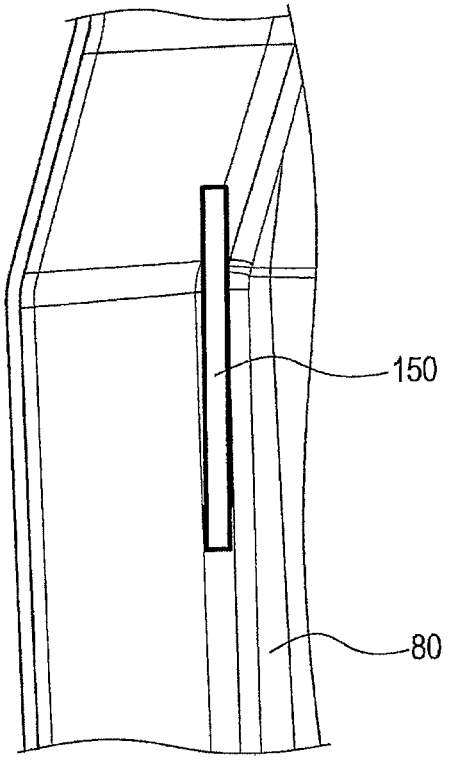
FIG. 13 is a view which installation of a reflection reducing apparatus in a bumper of a vehicle according to the second embodiment.

The reflection reducing device 150 is designed to be mounted in a place where a portion of a wave emitted from the antenna portions 60 is reflected by an object which exists in a direction of emission of the wave from the antenna portions 60 and then reaches the antenna portion 60 as the incoming wave. Specifically, the reflection reducing device 150 is, as demonstrated in FIGS. 12 and 13, engineered to be mounted inside the bumper 80 of a vehicle.

When the reflection reducing device 150 is located in the bumper 80, a portion of a wave emitted from the antenna portions 60 of the reflection reducing device 150 passes through the bumper 80, while a portion of the wave is reflected by the bumper 80 and then returned back to the reflection reducing device 150 as the incoming wave. The incoming wave is reflected again on the reflection reducing device 150. Interference of the reflected wave arising from reflection of the incoming wave with a radiated wave may cause the radiated wave to attenuate. A polarized wave of the reflected wave resulting from the reflection on the reflection reducing device 150 is rotated 90° from a horizontally polarized wave of the radiated wave. A polarized component of the reflected wave, therefore, has a relatively large vertically polarized component and a relatively small horizontally polarized component, thereby minimizing the interference between the reflected wave and the radiated wave.

Figure 10:
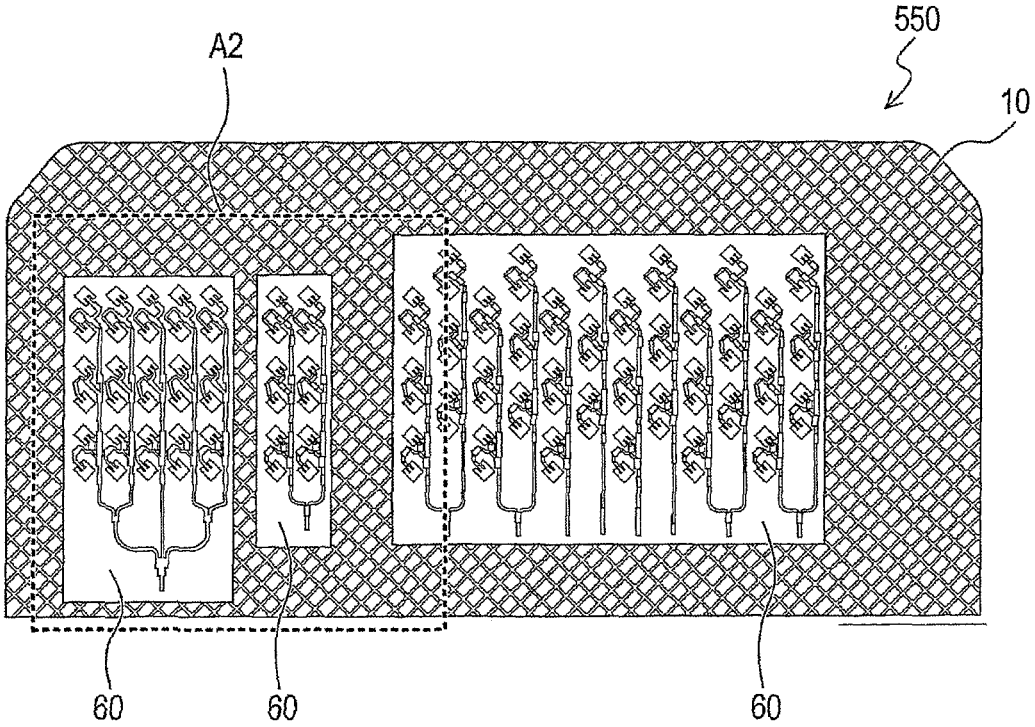
FIG. 10 is a plan view which illustrates a structure of a comparative example of a reflection reducing apparatus.
Figure 11:
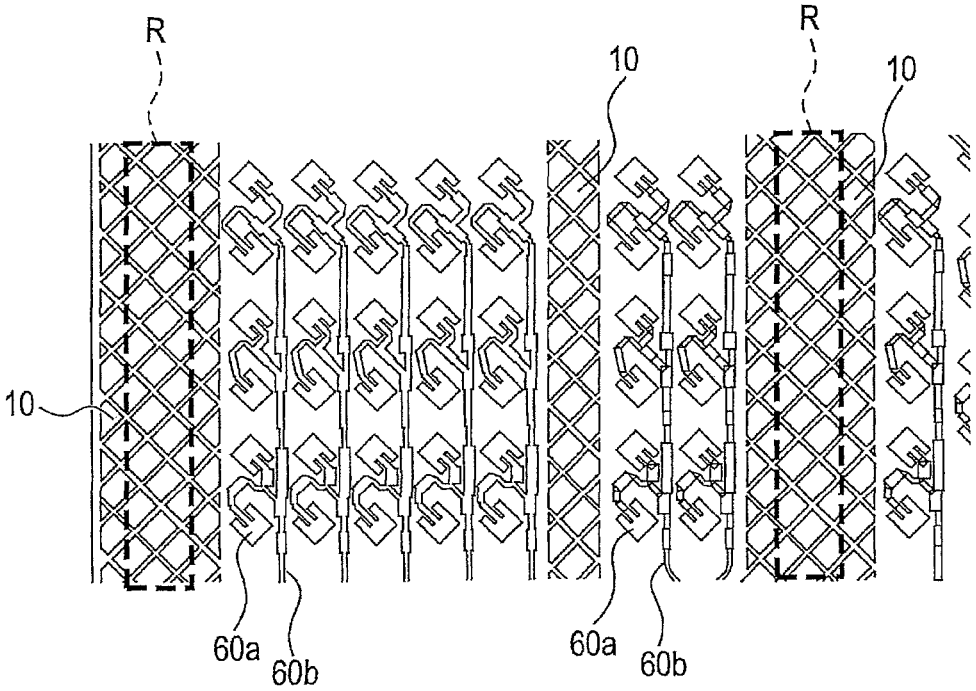
FIG. 11 is an enlarged view of a portion A2 in FIG. 10.

FIGS. 10 and 11 illustrate the reflection reducing device 550 as a comparative example. The reflection reducing device 550 has the antenna portions 60 and the first patch group mounted on the base plate front surface 30*a* without the second patch group. It is impossible for the reflection reducing device 550 to have the first conductive patches 10 merely arranged near the antenna portion 60 and in the periphery-inside region of the base plate front surface 30*a*. The first conductive patches 10 are, therefore, arranged in the shape of small-sized cut parts. The first conductive patches 10 disposed near the antenna portion 60 or in the periphery-inside region of the base plate front surface 30*a*, therefore, have a side which extends in the a direction and is shorter than the length La1 and also have a side which extends in the β direction and is shorter than the length Lβ1. Such first conductive patches 10, thus, do not function as a polarized wave turning unit. A portion of the reflection reducing device 550 serving as a polarized wave turning unit is, as illustrated in FIG. 11, provided by only regions R which are portions of an area in which the first conductive patches 10 are mounted except a region near the antenna portion 60 and a periphery-inside region of the base plate 30. The reflection reducing device 550 is, therefore, lower in polarized wave turning effect than the reflection reducing device 150.

Figure 14:
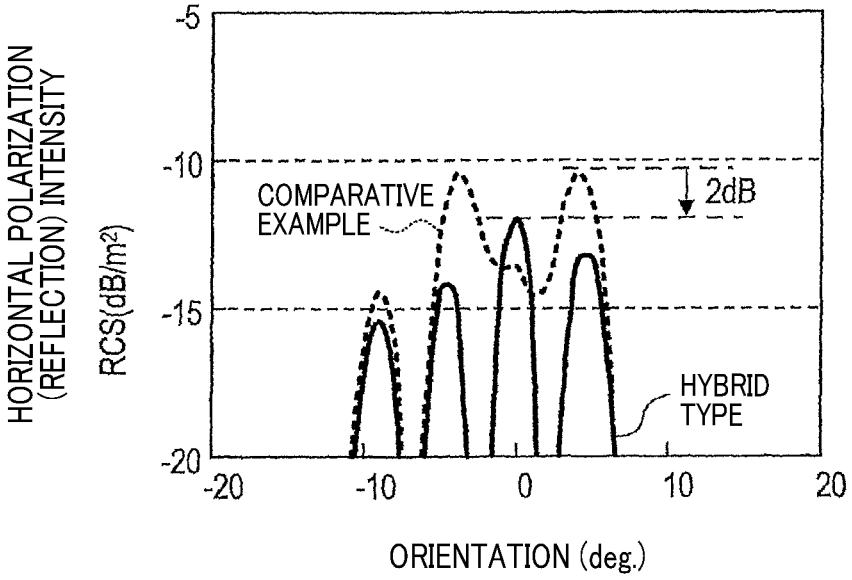
FIG. 14 is a graph which represents a relation between orientation of a reflection reducing apparatus and a reflection intensity in the second embodiment and a comparative example.

FIG. 14 represents results of simulations on intensity of a horizontally polarized wave component of a reflected wave when a horizontally polarized wave is emitted from the antenna portions 60 of the reflection reducing device 150 and the reflection reducing device 550 mounted in the bumper 80. The reflection reducing device 150 is lower in intensity of reflection of the horizontally polarized wave component by 2 dB than the reflection reducing device 550. This means that the reflection reducing device 150 minimizes the interference between the emitted wave and the reflected wave as compared with the reflection reducing device 550.

3 Advantageous Effects

The above described second embodiment offers the following beneficial effects in addition to the effects 1) to 4) in the first embodiment.

5) The first direction-oriented patch 20*a* and the second direction-oriented patch 20*b* which are smaller in size than the first conductive patches 10 are disposed in a region near the antenna portions 60 and in the periphery-inside region of the base plate front surface 30*a* where there is no space large enough to have the first conductive patches 10 arranged therein. This layout largely reduces the interference of a reflected wave with a radiated wave as compared with when the base plate front surface 30*a* has only the first conductive patches 10 arranged thereon.

6) The installation of the reflection reducing device 150 in the bumper 80 causes a portion of a wave radiated from the antenna portion 60 to be reflected by the bumper 80 and reach the reflection reducing device 150 in the form of the incoming wave. The first patch group and the second patch group work to turn the direction of polarization of a reflected wave arising from reflection of the incoming wave by 90°, thereby reducing the interference of the reflected wave with a wave emitted from the antenna portion 60 to minimize the attenuation of the emitted wave.

Other Embodiments

Figure 15:
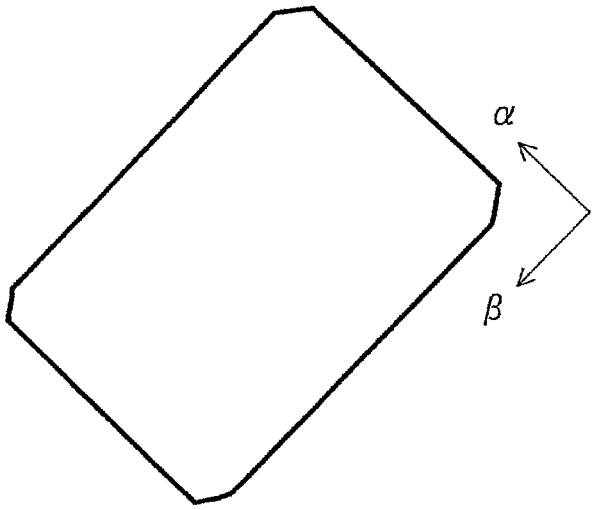
FIG. 15 is a view which illustrates a modification of a first conductive patch.
Figure 16:
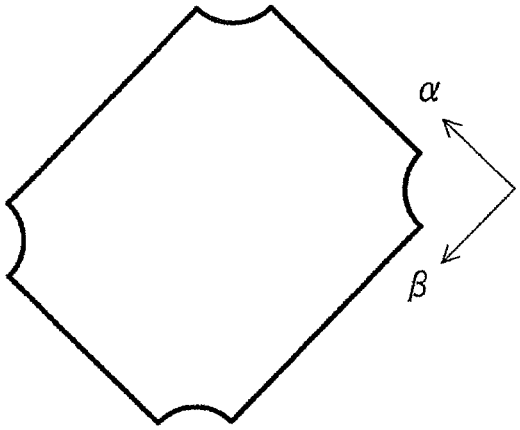
FIG. 16 is a view which illustrates another modification of a first conductive patch.
Figure 17:
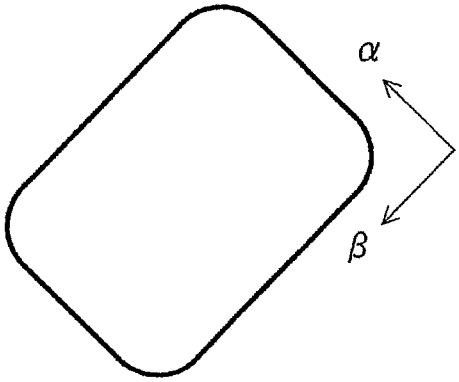
FIG. 17 is a view which illustrates another modification of a first conductive patch.

The embodiments embodying this disclosure have already been described, but this disclosure is not limited to the above embodiments and may be modified in various ways.

a) In the above embodiments, the first conductive patches 10, the first direction-oriented patches 20*a*, and the second direction-oriented patches 20*b* are inclined at 45° to the direction of polarization of the incoming wave, but such inclination is not limited to 45°. The reflection reducing devices 50 and 150 are effective to have the highest degree of polarized wave turning effects when the inclination is set to 45°. For instance, the polarized wave turning effects may be achieved by selecting the a direction and the β direction to lie in a range of 35° to 55° to the direction of polarization of the incoming wave.

b) in the above embodiments, a difference in reflection phase between the a direction and the β direction is set to 180°, but such a phase difference is not limited to 180° and may be greater than 0°. In other words, the reflection reducing devices 50 and 150 may be designed to turn the direction of polarization of the incoming wave at an angle less than 90° to produce a reflected wave. The adverse influence of the reflected wave may be reduced as long as there is a difference in direction of polarization between the reflected wave and the incoming wave.

c) In the above embodiments, the first conductive patches 10 are of a rectangular shape, but not limited to the same. For instance, the first conductive patches 10 may be, as illustrated in FIGS. 15 and 16, shaped to have a pattern in which all ends of two diagonal lines have triangular or quarter circular cut-outs. Each of the first conductive patches 10 illustrated in FIGS. 15 and 16 has two sides which are located on opposite sides of one of the cut-outs and extend in the a direction and the β direction, respectively. The first conductive patches 10 may alternatively be, as illustrated in FIG. 17, in the shape of a pattern in which all ends of two diagonal lines have a rounded or circular shape. Each of the first conductive patches 10 in FIG. 17 has two sides which are located on opposite sides of one of the rounded corners and extend in the a direction and the β direction, respectively.

Figure 18:
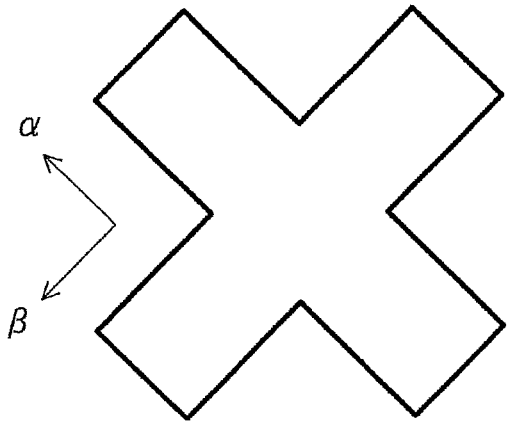
FIG. 18 is a view which illustrates another modification of a first conductive patch.
Figure 19:
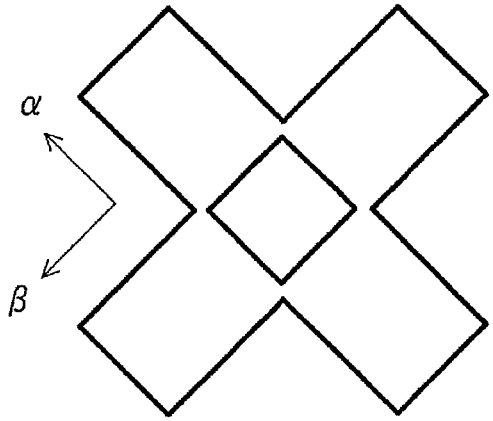
FIG. 19 is a view which illustrates another modification of a first conductive patch.

Each of the first conductive patches 10 may alternatively be, as illustrated in FIG. 18, designed to have a shape defined by two linear patterns intersecting with each other. The linear patterns of each of the first conductive patches 10 in FIG. 18 defines sides of the first conductive patch 10 extending in the a direction and the β direction, respectively. Each of the first conductive patches 10 may alternatively be, as illustrated in FIG. 19, designed to have a shape defined by two linear patterns intersecting with each other with a center cut-out. The linear patterns in FIG. 19 defines sides of the first conductive patch 10 extending in the a direction and the β direction, respectively.

Figure 20:
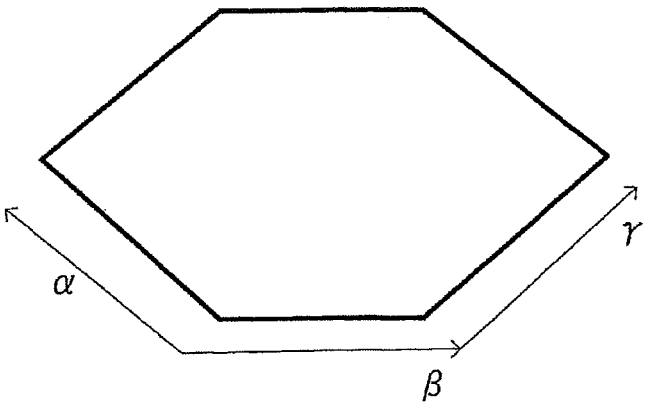
FIG. 20 is a view which illustrates another modification of a first conductive patch.
Figure 21:
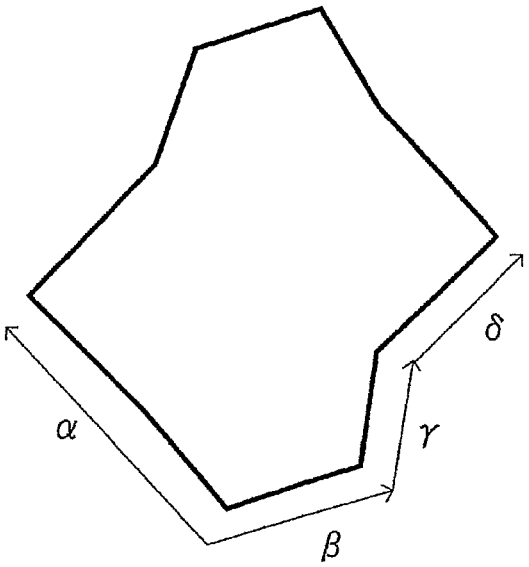
FIG. 21 is a view which illustrates another modification of a first conductive patch.

Each of the first conductive patches 10 may alternatively be, as illustrated in FIG. 20, designed to have a shape defined by a diamond pattern. The first conductive patch 10 in FIG. 20 resonates at sides extending in three directions: the a direction, the β direction, and the γ direction. In this case, the sides extending in the three directions are selected to have lengths which turn a direction of polarization of a wave made of a combination of wave components reflected in the three directions from a direction of polarization of the incoming wave. Each of the second conductive patches 20 is of a shape defined by a linear pattern resonating only in the a direction, a linear pattern resonating only in the β direction, and a linear pattern resonating only in the γ direction. Each of the first conductive patches 10 may alternatively be, as illustrated in FIG. 21, designed to have a shape defined by an axisymmetric octagonal pattern. Each of the first conductive patches 10 in FIG. 21 resonates at sides extending in four directions: the a direction, the β direction, the γ direction, and the 6 direction. In this case, the sides extending in the four directions are selected to have lengths which turn a direction of polarization of a wave made of a combination of wave components reflected in the four directions from a direction of polarization of the incoming wave. Each of the second conductive patches 20 is of a shape defined by a linear pattern resonating only in the a direction, a linear pattern resonating only in the β direction, a linear pattern resonating only in the γ direction, and a linear pattern resonating only in the 6 direction.

d) A plurality of functions of one component of the structure of each of the above embodiments may be realized by a plurality of components. Alternatively, a single function of one component of the structure of each of the embodiments may be achieved by a plurality of components. A plurality of functions of a plurality of components of the structure of each of the embodiments may also be realized by a single component. A single function performed by a plurality of components of the structure of each of the above embodiments may be realized by a single component. A portion of the components of each of the embodiments may be omitted. At least a portion of components of each of the embodiments may be added to or replaced with a component(s) of another embodiment.

The invention claimed is:

1. A reflection reducing apparatus comprising:

a dielectric base plate that has a first surface and a second surface;

a first patch group that is disposed on the first surface and includes a plurality of first conductive patches;

a second patch group that is disposed on the first surface and includes a plurality of second conductive patches; and a ground plane that is arranged on the second surface and works as a grounding surface, wherein the plurality of first conductive patches are electrically insulated from each other, each of the first conductive patches in which electrical currents, as excited by incoming waves that are radio waves arriving from outside the reflection reducing apparatus, resonating in directions at least including a first direction and a second direction, each of the first conductive patches being of a patch shape in which resonant lengths are different between the first and second directions, the second conductive patches are equipped with two or more kinds of conductive patches including at least one first direction-oriented patch and at least one second direction-oriented patch, the second conductive patches being arranged along an outer edge of the first patch group at an interval away from the first patch group, the first direction-oriented patch has a shape in which the electrical current resonates only in the first direction, the second direction-oriented patch having a shape in which the electrical current resonates only in the second direction and which has a resonant length different from that of the first direction-oriented patch.

2. The reflection reducing apparatus as set forth in claim 1, wherein the first direction and the second direction are inclined to a predetermined direction of polarization of the incoming waves.

3. The reflection reducing apparatus as set forth in claim 2, wherein the first conductive patches are inclined at the same angle to the direction of polarization and arranged at equal intervals away from each other.

4. The reflection reducing apparatus as set forth in claim 2, wherein the plurality of first conductive patches are of a shape which resonates in opposite phases between the first direction and the second direction, and the first direction-oriented patch and the second direction-oriented patch have shapes which resonate in phases opposite each other.

5. The reflection reducing apparatus as set forth in claim 4, wherein the first direction and the second direction are perpendicular to each other.

6. The reflection reducing apparatus as set forth in claim 4, wherein an outer edge of the first patch group includes at least one side extending in the first direction and at least one side extending in the second direction, the first direction-oriented patch is arranged along the side of said outer edge extending in the first direction, and the second direction-oriented patch is arranged along the side of said outer edge extending in the second direction adjacent the first direction-oriented patch.

7. The reflection reducing apparatus as set forth in claim 1, further comprising an antenna portion which is disposed on the first surface and designed to transmit or receive a radio wave, wherein the second patch group is arranged on the first surface near the antenna portion and in a periphery-inside region of the first surface, and the first patch group is arranged in a region on the first surface except the antennal portion, a region near the antennal portion, and in the periphery-inside region.

8. The reflection reducing apparatus as set forth in claim 7, wherein the first direction and the second direction are inclined to a direction of polarization of a radio wave transmitted from the antenna portion.

* * * * *